United States Patent [19]

Markey

[11] Patent Number: 4,534,588

[45] Date of Patent: Aug. 13, 1985

[54] ENGINE LIFTING TOOL

[76] Inventor: John W. Markey, 2713 Sorrell St., Baton Rouge, La. 70805

[21] Appl. No.: 603,682

[22] Filed: Apr. 25, 1984

[51] Int. Cl.[3] ..... B66C 1/16

[52] U.S. Cl. ..... 294/81.5; 294/67.1; 294/82.11

[58] Field of Search ..... 294/67 R, 67 AA, 74, 294/78 R, 78 A, 81 R, 82 R, 82 AH

[56] References Cited

U.S. PATENT DOCUMENTS

| | | | |
|---|---|---|---|
| 1,326,969 | 1/1920 | Rounds | 294/78 A |
| 1,512,149 | 10/1924 | Wagner | 294/78 R |
| 1,535,022 | 4/1925 | Jenkins | 294/78 R |
| 2,412,488 | 12/1946 | Austin | 294/78 A |
| 3,751,097 | 4/1971 | Jones | 294/78 A |
| 3,905,633 | 9/1974 | Larson | 294/82 R |
| 3,995,903 | 8/1975 | Ernst | 294/81 R |
| 4,431,223 | 2/1984 | Miller | 294/78 A X |

FOREIGN PATENT DOCUMENTS

| | | | |
|---|---|---|---|
| 624672 | 6/1949 | United Kingdom | 294/78 A |

*Primary Examiner*—Johnny D. Cherry
*Attorney, Agent, or Firm*—David L. Ray

[57] ABSTRACT

A lifting tool for lifting an internal combustion engine having an intake manifold, the lifting tool including a mounting plate for connecting to the intake manifold of the engine, the mounting plate having a plurality of holes therein aligned with bolt holes or studs in the intake manifold, a "U"-shaped bracket connected to the mounting plate for receipt of a hook or chain connected to a lifting device such as a chain hoist, and a plurality of safety chains connected to the "U"-shaped bracket for connecting to the engine to prevent the engine from falling to the ground if the "U"-shaped bracket should separate from the mounting plate or if the mounting plate should separate from the engine while the engine is being hoisted.

17 Claims, 5 Drawing Figures

ENGINE LIFTING TOOL

BACKGROUND OF THE INVENTION

1. Field of the Invention

The present invention is related to devices for lifting internal combuston engines from vehicles such as automobiles and trucks, or from watercraft such as boats or barges. More particularly, the present invention is related to a tool for attaching to the intake manifold of an internal combustion engine for lifting the internal combustion engine from the vehicle or boat in which the engine is located.

2. Description of the Prior Art

Difficulty has long been encountered in removing internal combustion engines from such vehicles as cars and trucks, or from a boat. Commonly, when using a chain hoist or other hoisting device to remove an engine from a vehicle or boat, more than one person is required to steady and guide the engine as it is being lifted from the vehicle or boat. Engines are sometimes damaged while being hoisted and also damage is sometimes done to the vehicle or boat from which the engine is being removed. It is quite common for an engine being hoisted to tilt to one side or the other, or to the front or back, as soon as the engine begins to rise from the vehicle or boat in which it was mounted. At small engine repair shops where only one or two employees are working, it is time consuming and often quite difficult to remove an engine from a vehicle or boat.

Various devices have been disclosed in the prior art to attach to an engine to facilitate removal of the engine from a boat or vehicle in which the engine is mounted. U.S. Pat. No. 3,995,903 discloses an engine lifting tool which includes a yoke member having inverted "U"-shaped bails or lift members supported on opposite ends thereof. The respective undersides of the bail members are provided with a plurality of notches which engage the yoke member to hold the bails in adjusted transverse position relative to the yoke member and a lifting ring encircles the yoke member and is movable longitudinally thereof for engagement with a plurality of notches provided along its underside. The lifting ring can be moved from one notch to another to balance the engine to accommodate engines having different weight distributions. The yoke members, bale members, and lifting rings are constructed so as to be inseparable one from the other. Such a device has four separate parts and must be adjusted to accommodate the device to various types of engines. Furthermore, if the device should fail there are no safety chains or other apparatus to prevent the engine from falling to the ground.

U.S. Pat. No. 3,905,633 discloses a swivel mounted lifting eye adapted to be attached to an engine block or a cylinder head by a single bolt. The lifting eye includes a pair of annular members having hub portions disposed in back to back relationship to define an annular groove on the periphery of axially spaced base portions thereof. A ring member is rotatably mounted in the groove and a "U"-shaped lifting eye is pivotally mounted on a pair of projections secured to a ring member and extending radially outwardly therefrom. There is no provision for balancing the engine nor is their any provision to prevent the engine from twisting or moving when it is lifted from the vehicle or boat on which it is mounted.

U.S. Pat. No. 3,751,097 discloses an adjustable engine lifting tool having a threaded shaft rotatably mounted at the top of the tool for adjusting the engine angle to clear motor mounts or align the engine to the transmission. The lifting tool includes a horizontal mounting plate for connecting the tool to the engine, the mounting plate being connectable to studs on which an engine part such as a carburetor is removably attached. The adjustable engine lifting tool has many different parts including several parts which are movable relative to each other. Furthermore, the lifting device has no safety apparatus for connecting to the engine in the event the device should be disconnected from the engine or broken.

SUMMARY OF THE INVENTION

In accordance with the present invention there is provided a lifting tool for lifting an internal combustion engine having an intake manifold, the lifting tool including a mounting plate for connecting to the intake manifold of the engine, the mounting plate having a plurality of holes therein aligned with bolt holes or studs in the intake manifold, a "U"-shaped bracket connected to the mounting plate for receipt of a hook or chain connected to a lifting device such as a chain hoist, and a plurality of safety chains connected to the "U"-shaped bracket for connecting to the engine to prevent the engine from falling to the ground if the "U"-shaped bracket should separate from the mounting plate or if the mounting plate should separate from the engine while the engine is being hoisted.

The present invention permits a single mechanic to safely and efficiently remove an engine from a vehicle or a boat without damaging the engine, the vehicle, or the boat. The tool of the present invention is particularly adapted for removing standard V-8 or V-6 engines from automobiles and boats when connected to the intake manifold of such engines after removal of the carburetor. Most standard V-8 or V-6 engines will be balanced when lifted with the tool of the invention and will not tilt from side to side or from one end to another when being removed from the boat or vehicle.

Furthermore, the safety chains provided with the lifting tool of the invention can be connected to the sides of the engine and therefore provide a safety feature which prevents the engine from falling and being damaged or damaging the boat or vehicle if the mounting plate should break or become disconnected from the intake manifold.

The lifting tool of the present invention is simple to construct and therefore much lower in cost than the lifting tools of the prior art.

BRIEF DESCRIPTION OF THE DRAWINGS

The invention will be more clearly understood by the reference to the drawings in which.

DESCRIPTION OF THE PREFERRED EMBODIMENTS

Figure 1:
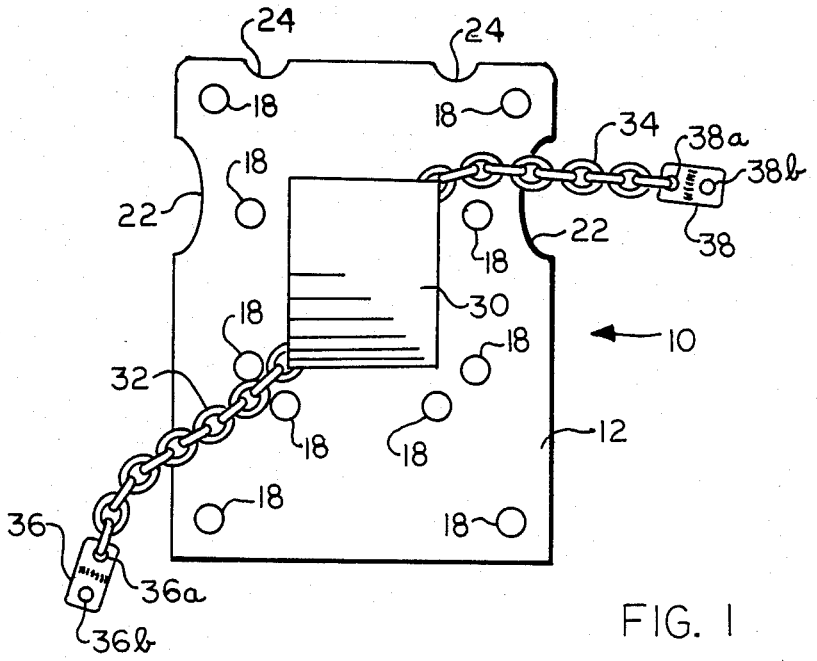
FIG. 1 is a top plan view of the lifting tool of the invention.
Figure 2:
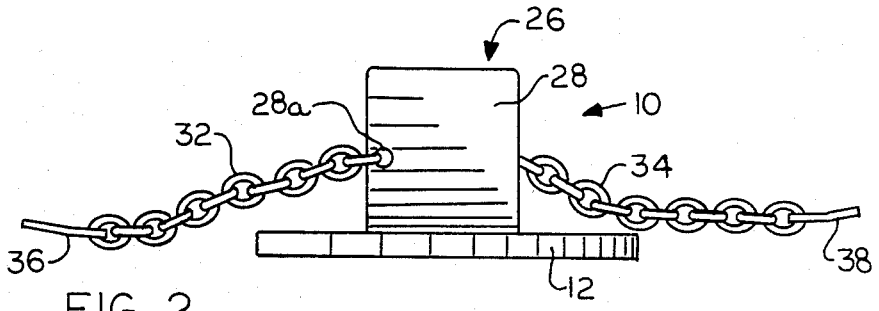
FIG. 2 is a side elevational view of the lifting tool of the invention.
Figure 3:
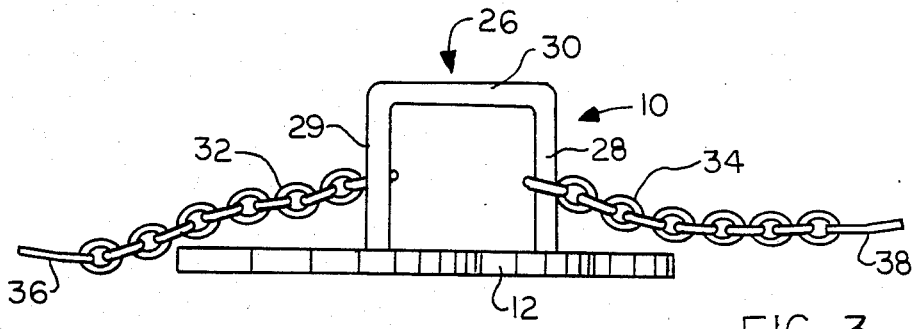
FIG. 3 is a side elevational view of the lifting tool of FIG. 1 from a view rotated 90 degrees from that of FIG. 2.

Referring now to the drawings, the lifting tool of the present invention is generally indicated by the numeral 10. The lifting tool has a flat mounting plate 12 for connecting to the intake manifold 14 shown in FIG. 5 of an internal combustion engine generally indicated by the numeral 16 in FIGS. 4 and 5. The mounting plate 12 has a series of holes 18 drilled therein for receipt of studs 20 extending from the intake manifold such as those shown in FIGS. 4 and 5, or bolts which may be inserted down through the holes into threaded holes in the intake manifold of the engine 16 if such holes are available.

The holes 18 may be arranged so that they fit a variety of intake manifolds so that the lifting tool may be used with a variety of engines. Furthermore, there may be a variety of recesses such as indicated at 22 and 24 so that mounting plate 12 can fit to the intake manifold of a variety of engines.

Extending upwardly from mounting plate 12 is the lifting bracket generally indicated by the numeral 26. Lifting bracket 26 is generally "U"-shaped and has two vertical sidewalls 28 and 29. The top ends of the sidewalls 28 and 29 are connected by a horizontal member 30. Horizontal member 30 can be molded or forged as one piece with the sidewalls 28 and 29, and such a construction is preferred. However, if desired, member 30 could be welded to the sidewalls 28 and 29.

The bases or bottoms of sidewalls 28 and 29 are rigidly connected to mounting plate 12. The bottom walls of 28 and 29 may be rigidly connected to mounting plate 12 by welding or by any other conventional means.

A hole **28*a* is located in the sidewall 28 and a corresponding hole (not shown) is located in the sidewall 29 for receipt of safety chains 32 and 34**.

Figure 4:
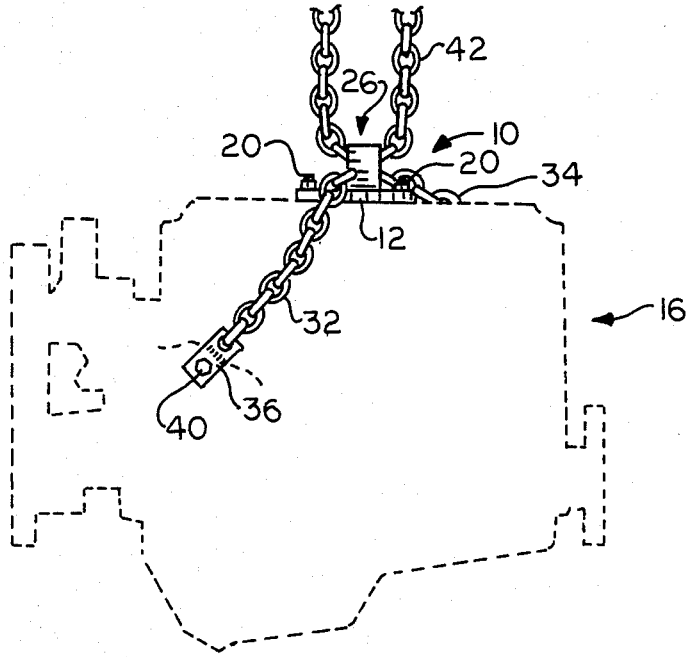
FIG. 4 is a side view of an engine shown in phantom lines having the lifting tool of the invention connected thereto.

Safety chains 32 and 34 have connecting plates 36 and 38 connected thereto, respectively. Each of the connecting plates 36 and 38 have holes **36*a* and 36*b* and 38*a* and 38*b*, respectively, formed therein. Safety chain 34 is received through hole 38*a* and safety chain 32 is received through hole 36*a*. Hole 36*b* receives bolt 40 as shown in FIG. 4 when the lifting tool is connected to an automobile engine 16 and safety chains 32 and 34 are connected to the engine. In the same manner a bolt (not shown) is inserted through hole 38*b* of connecting plate 38. Connecting plates 36 and 38 can be connected at any point on engine 16** to which a bolt or stud may be connected.

A lifting chain 42 shown in FIG. 4 is inserted through lifting bracket 26. Lifting chain 42 can be connected to a chain hoist or any other lifting structure.

Figure 5:
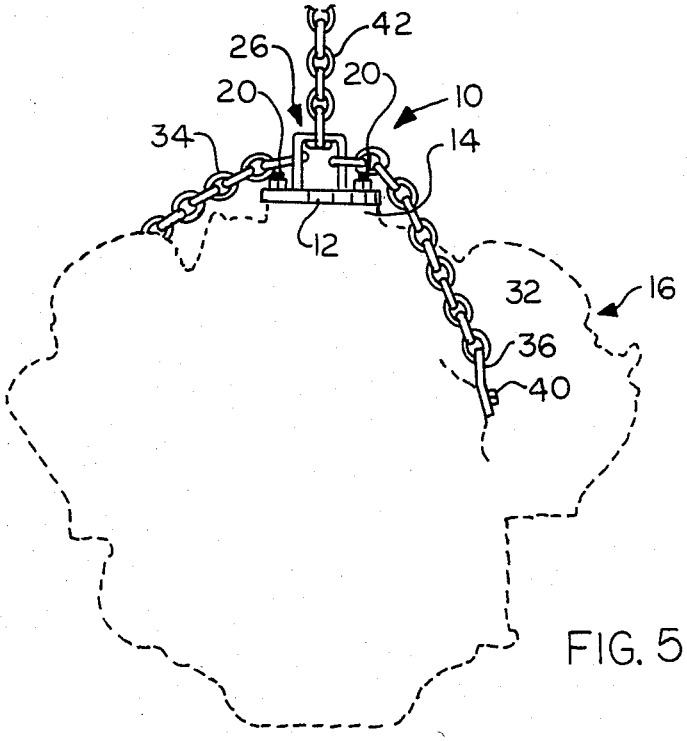
FIG. 5 is a front view of the engine shown in FIG. 4.

Thus, it can be seen that an engine may be easily lifted from a vehicle or boat through the use of the lifting tool of the present invention. Mounting plate 12 is connected to the intake manifold 14 by studs 20 in conjunction with the nuts screwed onto studs 20 shown in FIGS. 4 and 5. The studs are inserted in any of the holes 18 which are in line with the studs. Safety chains 32 and 34 are connected as indicated in FIGS. 4 and 5, and lifting chain 42 is inserted through lifting bracket 26. Upward forces are applied to chain 42 and the engine is evenly lifted from the vehicle or boat in which it is mounted, and is balanced on the lifting tool so that the engine does not tilt from side to side or backwards and forwards.

Although the preferred embodiments of the present invention have been disclosed and described in detail above, it should be understood that the invention is in no sense limited thereby, and its scope is to be determined by that of the following claims.

What is claimed:

1. A lifting tool for lifting an internal combustion engine having an intake manifold connected thereto, said intake manifold having threaded holes or studs therein, comprising:

a. mounting plate means for connecting to the intake manifold of said engine, said mounting plate means having a plurality of holes therein aligned with threaded holes or studs in said intake manifold, b. a "U"-shaped bracket means connected to said mounting plate means for receipt of lifting means connected to an engine hoist, and c. safety chain means connected to said "U"-shaped bracket means for connecting to said engine to prevent said engine from falling to the ground if said "U"-shaped bracket should separate from said mounting plate means or if said mounting plate means should separate from said engine while said engine is being hoisted.

2. The lifting tool of claim 1 wherein said safety means comprises two chains, each of said two chains having a first end and a second end, each of said chains being connected at said first end to said "U"-shaped bracket means.

3. The lifting tool of claim 2 wherein each of said chains has a connecting plate connected to said second end.

4. The lifting tool of claim 1 wherein said mounting plate means comprises a flat metal plate having a plurality of holes therein aligned with threaded holes or studs in said intake manifold.

5. The lifting tool of claim 1 wherein said mounting plate means has recessed portions in the sides thereof.

6. The lifting tool of claim 1 wherein said "U"-shaped bracket means includes two spaced apart vertical side walls extending perpendicularly upward from said mounting plate means.

7. The lifting tool of claim 6 wherein said "U"-shaped mounting bracket has a horizontal member connected to the top edge of said two spaced apart vertical sidewalls.

8. A lifting tool for lifting an internal combustion engine having an intake manifold connected thereto, said intake manifold having threaded holes or studs therein, comprising:

a. mounting plate means for connecting to the intake manifold of said engine, said mounting plate means comprising a flat plate having a plurality of holes therein aligned with threaded holes or studs in said intake manifold, b. a "U"-shaped bracket means connected to said mounting plate means for receipt of lifting means connected to an engine hoist, and c. safety chain means connected to said "U"-shaped bracket means for connecting to said engine to prevent said engine from falling to the ground if said "U"-shaped bracket should separate from said mounting plate means or if said mounting plate means should separate from said engine while said engine is being hoisted.

9. The lifting tool of claim 8 wherein said safety means comprises two chains, each of said two chains having a first end and a second end, each of said chains being connected at said first end to said "U"-shaped bracket means.

10. The lifting tool of claim 9 wherein each of said chains has a connecting plate connected to said second end.

11. The lifting tool of claim 9 wherein said mounting plate means has recessed portions in the sides thereof.

12. The lifting tool of claim 9 wherein said "U"-shaped bracket means includes two spaced apart vertical side walls extending perpendicularly upward from said mounting plate means.

13. The lifting tool of claim 12 wherein said "U"-shaped mounting bracket has a horizontal member connected to the top edge of said two spaced apart vertical sidewalls.

14. A lifting tool for lifting an internal combustion engine having an intake manifold connected thereto, said intake manifold having threaded holes or studs therein, comprising:

a. mounting plate means for connecting to the intake manifold of said engine, said mounting plate means comprising a flat plate having a plurality of holes therein aligned with threaded holes or studs in said intake manifold, b. a "U"-shaped bracket means connected to said mounting plate means for receipt of lifting means connected to an engine hoist, said "U"-shaped bracket means including two spaced apart vertical sidewalls extending perpendicularly upward from said mounting plate means connected at their top ends by a horizontal member, and c. safety chain means connected to said "U"-shaped bracket means for connecting to said engine to prevent said engine from falling to the ground if said "U"-shaped bracket should separate from said mounting plate means or if said mounting plate means should separate from said engine while said engine is being hoisted.

15. The lifting tool of claim 14 wherein said safety means comprising two chains, each of said two chains having a first end and a second end, each of said chains being connected at said first end to said "U"-shaped bracket means.

16. The lifting tool of claim 15 wherein each of said chains has a connecting plate connected to said second end.

17. The lifting tool of claim 15 wherein said mounting plate means has recessed portions in the sides thereof.

* * * * *